US008616652B1

(12) United States Patent
Wells

(10) Patent No.: US 8,616,652 B1
(45) Date of Patent: Dec. 31, 2013

(54) ARTICULATING FOOT-ELEVATING SUPPORT

(76) Inventor: Mario Wells, Chesapeake, VA (US)

( * ) Notice: Subject to any disclaimer, the term of this patent is extended or adjusted under 35 U.S.C. 154(b) by 306 days.

(21) Appl. No.: 13/190,551

(22) Filed: Jul. 26, 2011

(51) Int. Cl.
*A47C 7/50* (2006.01)

(52) U.S. Cl.
USPC ..... 297/423.39; 297/423.14; 297/423.41; 297/423.42; 297/423.45; 297/423.46; D3/200; D3/270; D6/349

(58) Field of Classification Search
USPC ..... 297/423.14, 423.39, 423.41, 423.42, 297/423.43, 423.44, 423.45, 423.46; D3/200, 270; D6/349
See application file for complete search history.

(56) References Cited

U.S. PATENT DOCUMENTS

| | | | | | |
|---|---|---|---|---|---|
| 269,780 | A | * | 12/1882 | Fenny | 297/423.46 |
| 461,974 | A | * | 10/1891 | Button | 297/423.14 X |
| 516,716 | A | * | 3/1894 | Wheeler | 297/423.14 X |
| 815,046 | A | * | 3/1906 | Sherman | 297/423.45 X |
| 942,965 | A | * | 12/1909 | Cramer | 297/423.14 |
| 956,681 | A | * | 5/1910 | Clarke | 297/423.46 X |
| D48,826 | S | | 4/1916 | Knowles | |
| 1,396,100 | A | * | 11/1921 | Davis et al. | 297/423.14 |
| 1,618,221 | A | * | 2/1927 | Pertram | 297/423.14 X |
| 2,017,433 | A | * | 10/1935 | Carrington | 297/423.46 X |
| 2,248,369 | A | * | 7/1941 | Ludersen | 297/423.45 X |
| 2,667,658 | A | * | 2/1954 | Cornick | 297/423.14 X |
| 2,748,838 | A | * | 6/1956 | Scholl | 297/423.41 |
| 2,991,495 | A | * | 7/1961 | Blalack | D3/200 X |
| 3,155,364 | A | * | 11/1964 | Berg | 297/423.45 X |
| 3,220,772 | A | * | 11/1965 | Lucky | 297/423.42 |
| 3,653,715 | A | | 4/1972 | Drabert et al. | |
| D262,667 | S | | 1/1982 | Thompson | |
| 4,586,207 | A | * | 5/1986 | Cornette | 297/423.41 X |
| 4,813,742 | A | * | 3/1989 | Cardinael | 297/423.41 |
| 4,991,908 | A | * | 2/1991 | Krechel | 297/423.41 |
| D332,184 | S | | 1/1993 | Becker | |
| 5,419,618 | A | * | 5/1995 | Hatcher | 297/423.46 |
| D368,496 | S | * | 4/1996 | Seger | D14/419 |
| 5,536,071 | A | | 7/1996 | Kraftick | |
| 5,577,806 | A | * | 11/1996 | Ugalde | 297/423.46 |
| 5,584,535 | A | * | 12/1996 | Jacobson et al. | 297/423.46 |
| 5,765,921 | A | * | 6/1998 | Chuang | 297/423.46 |
| 6,065,807 | A | | 5/2000 | Going et al. | |
| 6,089,667 | A | * | 7/2000 | Hobbs | 297/423.45 X |
| D455,252 | S | | 4/2002 | Hagans, III | |
| D473,711 | S | * | 4/2003 | Bassignani | D3/270 |
| D504,578 | S | | 5/2005 | Moser | |
| 7,017,708 | B1 | * | 3/2006 | Lynn | 297/423.39 X |
| 7,354,110 | B1 | | 4/2008 | Raghubir | |
| 8,414,079 | B1 | * | 4/2013 | Zenoff | 297/423.46 |
| 2003/0071508 | A1 | * | 4/2003 | Lu | 297/423.43 |

* cited by examiner

*Primary Examiner* — Rodney B White

(57) ABSTRACT

The articulating foot-elevating support includes a base into which a hydraulically actuated cylinder of telescoping sections arises therefrom to support a foot-shaped footrest thereon. The articulating foot-elevating support is designed for a specific use of aiding an end user in tying shoes onto his/her feet. The footrest can articulate about a pivot point atop the topmost telescoping section in a manner consistent with that of an ankle of a foot. The footrest includes an imprint of a foot thereon, which is a visual aid to an end user as to placement and orientation of a foot to be placed thereon. The hydraulically actuated cylinder includes multiple telescoping sections that enable the footrest elevation to be raised and lowered. The foot-shaped footrest may include a heel stop that prevents a foot from sliding off of the foot-shaped footrest when in use.

7 Claims, 5 Drawing Sheets

ARTICULATING FOOT-ELEVATING SUPPORT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of foot supports, more specifically, an articulating support for use in tying a shoelace.

B. Discussion of the Prior Art

As a preliminary note, it should be stated that there is an ample amount of prior art that deals with foot supports generally. As will be discussed immediately below, no prior art discloses an articulating foot-elevating support wherein a foot-shaped footrest is seated atop a hydraulically actuated cylinder such that the footrest may be adjusted elevationally; wherein the footrest can articulate about a pivot point in a manner consistent with movement of the foot about the ankle; wherein the foot-shaped footrest includes a heel stop that prevents a foot from sliding off of the foot-shaped foot rest when in use.

The Raghubir Patent (U.S. Pat. No. 7,354,110) discloses a foot stool that includes a plurality of legs, a foot support carried by the plurality of legs, and an elongated heel slot provided in the foot support. However, the foot stool is not capable of articulating and raising and lowering in a real-time manner.

The Drabert et al. Patent (U.S. Pat. No. 3,653,715) discloses an adjustable foot rest. Again, the foot rest is not directed to use with tying a shoe on a foot, and which articulates the foot thereon.

The Scholl Patent (U.S. Pat. No. 2,748,838) discloses a foot rest cushion. However, the foot rest cushion is not a device for use in tying ones shoes in which an elevating foot-shaped support can raise elevtionally to provide a place onto which an end user may place a foot.

The Kraftick Patent (U.S. Pat. No. 5,536,071) discloses a footrest for relieving back fatigue and pain. However, the footrest does not articulate or elevate to aid an end user in resting a foot thereon for the purpose of tying one's shoe thereon.

The Going et al. Patent (U.S. Pat. No. 6,065,807) discloses an adjustable foot support that provides several user selectable heights to accommodate a wide variety of users. However, the foot support is stationary and does not feature a foot-shaped rest that can articulate and adjust elevationally in order for said foot rest to be an aid in tying one's shoe thereon.

The Thompson Patent (U.S. Pat. No. Des. 262,667) illustrates an ornamental design for a shoe tie stand, which does not supply an elevation or articulating foot rest.

The Hagans Patent (U.S. Pat. No. Des. 455,252) illustrates an ornamental design for a shoe and boot support stand for use during polishing, which does not articulate or adjust elevationaly via a hydralically actuated cylinder.

The Knowles Patent (U.S. Pat. No. Des. 48,826) illustrates an ornamental design for a shoe polishing stand, which does not articulate or adjust elevationally via hydraulically actuated cylinder.

While the above-described devices fulfill their respective and particular objects and requirements, they do not describe an articulating foot-elevating support wherein a foot-shaped footrest is seated atop a hydraulically actuated cylinder such that the footrest may be adjusted elevationally; wherein the footrest can articulate about a pivot point in a manner consistent with movement of the foot about the ankle; wherein the foot-shaped footrest includes a heel stop that prevents a foot from sliding off of the foot-shaped foot rest when in use. In this regard, the articulating foot-elevating support departs from the conventional concepts and designs of the prior art.

SUMMARY OF THE INVENTION

The articulating foot-elevating support includes a base into which a hydraulically actuated cylinder of telescoping sections arises therefrom to support a foot-shaped footrest thereon. The articulating foot-elevating support is designed for a specific use of aiding an end user in tying shoes onto his/her feet. The footrest can articulate about a pivot point atop the topmost telescoping section in a manner consistent with that of an ankle of a foot. The footrest includes an imprint of a foot thereon, which is a visual aid to an end user as to placement and orientation of a foot to be placed thereon. The hydraulically actuated cylinder includes multiple telescoping sections that enable the footrest elevation to be raised and lowered. The foot-shaped footrest may include a heel stop that prevents a foot from sliding off of the foot-shaped footrest when in use.

An object of the invention is to provide a footrest for use in tying one's shoe thereon.

A further object of the invention is to provide a footrest that is in the shape of a foot and of which includes a foot imprint thereon so as to provide a visual indication as to orientation and location.

A further object of the invention is to provide a footrest that can be adjusted elevationally with respect to a base via a hydraulically actuated cylinder.

A further object of the invention is to provide a footrest that can articulate atop the topmost telescoping section of the hydraulically actuated cylinder.

A further object of the invention is to provide a heel stop located on the foot-shaped footrest, which is impacted upon by the heel portion of the foot and/or shoe, and which will prevent the foot from slipping off of the foot-shaped footrest when in use.

These together with additional objects, features and advantages of the articulating foot-elevating support will be readily apparent to those of ordinary skill in the art upon reading the following detailed description of presently preferred, but nonetheless illustrative, embodiments of the articulating foot-elevating support when taken in conjunction with the accompanying drawings.

In this respect, before explaining the current embodiments of the articulating foot-elevating support in detail, it is to be understood that the articulating foot-elevating support is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the articulating foot-elevating support.

It is therefore important that the claims be regarded as including such equivalent construction insofar as they do not depart from the spirit and scope of the articulating foot-elevating support. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. An articulating foot-elevating support 100 (hereinafter invention) includes a footrest 101, a base 102, and an elevating means 103.

The base 102 and the footrest 101, when seated thereon, form a box. Both the base 102 and the footrest 101 have curved ends. The footrest 101 includes a foot imprint 101A on a top surface of the footrest 101.

Figure 1:
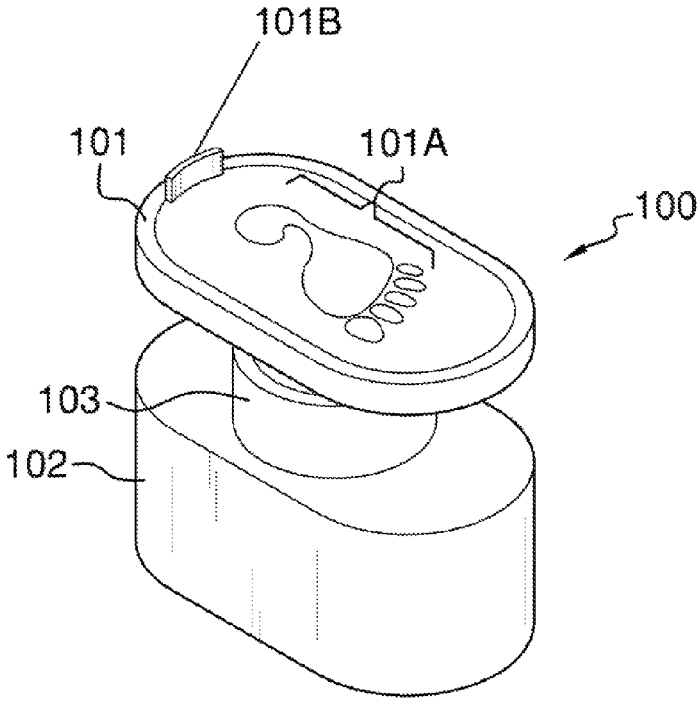
FIG. 1 illustrates a perspective view of the articulating foot-elevating support in which the footrest is partially raised from the base.
Figure 2:
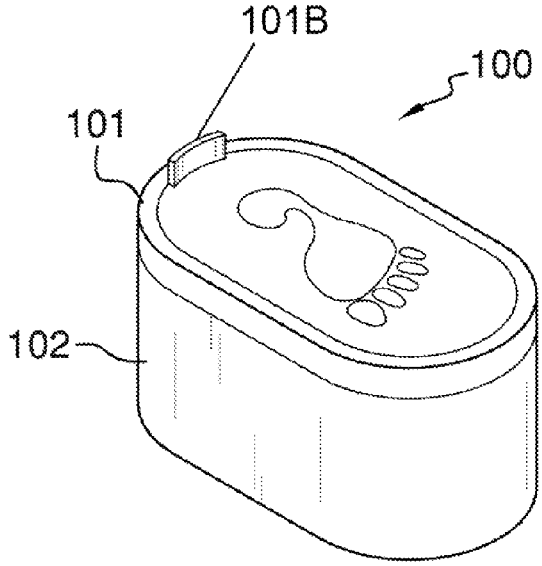
FIG. 2 illustrates a perspective view of the articulating foot-elevating support in which the footrest is lowered to and touches a top of the base.
Figure 3:
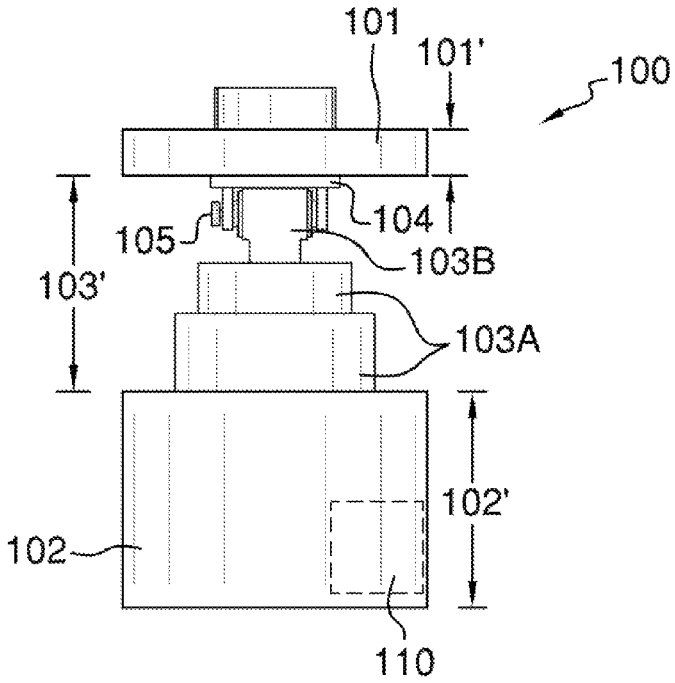
FIG. 3 illustrates an end view of the articulating foot-elevating support, and detailing the multiple telescoping sections that extend and retract from the base.
Figure 4:
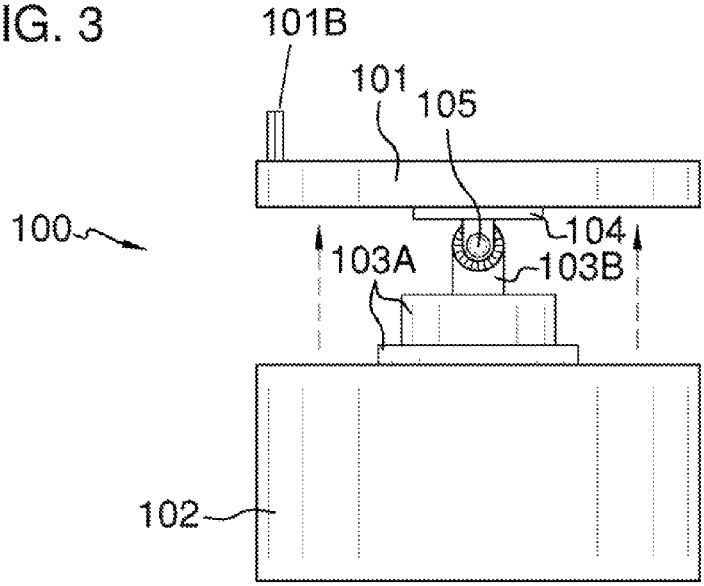
FIG. 4 illustrates a side view of the articulating foot-elevating support in which arrows indicate raising motion of the footrest from the base via the telescoping sections.
Figure 5:
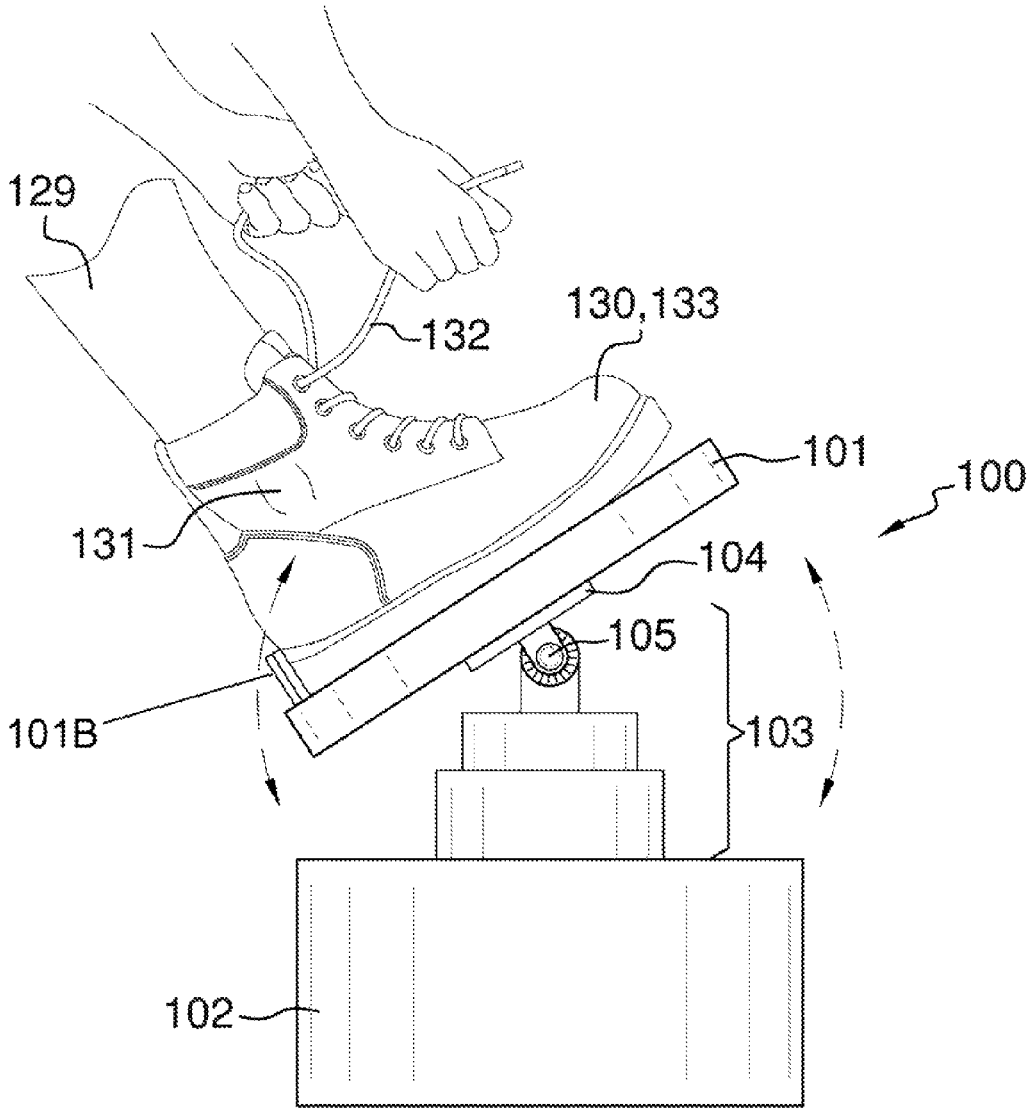
FIG. 5 illustrates a side view of the articulating foot-elevating support in which detail is provided as the footrest articulates about a pivot point and wherein the heel stop is impacted upon via the heel portion of the shoe so as to prevent slippage.

The footrest 101 is further defined by a height 101'; whereas the base 102 has a height 102' (see FIG. 3). The footrest 101 features a heel stop 101B, which is used to prevent a shoe 133 or a foot 130 from sliding off of the footrest 101 when in use (see FIGS. 1-2, and 5).

The elevating means 103, when retracted, is enclosed within the footrest 101 and the base 102. The elevating means 103 can raise and lower the footrest 101 with respect to the base 102. The elevating means 103 can raise the footrest 101 a distance 103' (see FIG. 3).

The elevating means 103 is further defined as a plurality of telescoping sections 103A that extend from one another, and decrease in diameter. The telescoping sections 103A include a topmost telescoping section 103B, which attaches to a bracket 104. The bracket 104 enjoys a pivot point 105 with the topmost telescoping section 103B, and can articulate the footrest 101. The bracket 104 is secured to a bottom surface of the footrest 101. The pivot point 105 provides the footrest 101 with movement along a single axis, and in a manner consistent with that of an ankle 131 of the foot 130.

It shall be re-asserted that the primary use of the invention 100 is to enable the end user 129 to tie shoelaces 132 of the shoe 133 upon placement of said shoe 133 on the footrest 101, and in the orientation and location designated by the foot imprint 101A.

The elevating means 103 employs the use of hydraulically operated cylinders that represent each telescoping section 103A. The hydraulically operated cylinders of each telescoping section 103A are concentrically aligned with one another, and work with a reservoir 110 that is located within the base 102. The elevating means 103 operates by placing one's foot onto the footrest 101 when at a lowered state as depicted in FIG. 2, and upon placement of weight thereon and subsequent release shall engage the elevating means 103 to extend upwardly the height 103'. Next, the end user 129 shall place his or her shoe 133 on the footrest 101, and commence to tying or untying the shoe laces 132 while thereon. Once, the desired task is completed, the end user 129 shall push the footrest 101 down until the footrest 101 is resting atop the base 102, and at which time the elevating means 103 shall lock in a lowered position.

It shall be noted that when the end user 129 is tying/untying his/her shoe 133 on the footrest 101, the footrest 101 is free to pivot about the pivot point 105. It shall be further noted that the amount of force or weight required to seat and unseat the elevating means 103 before and after use of the footrest 101 is minimal and attributable to the scale of the hydraulically operated cylinders being used in concert with the pressure stored within the reservoir 110.

Figure 6:
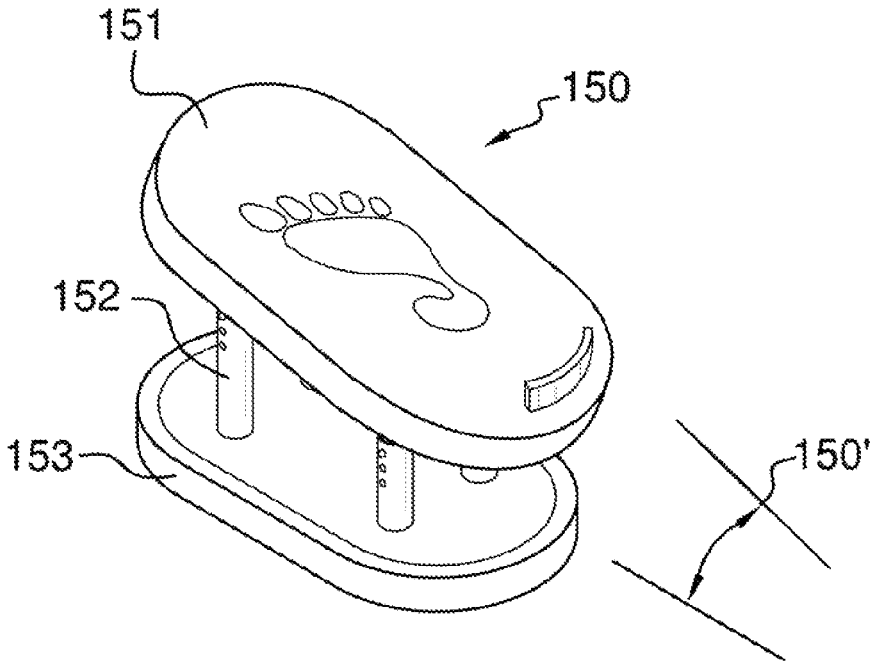
FIG. 6 illustrates an alternative embodiment involving multiple rods of varying heights that support a footrest at a fixed inclination and elevation from a base, and wherein said embodiment can be collapsed for storage when not in use.
Figure 7:
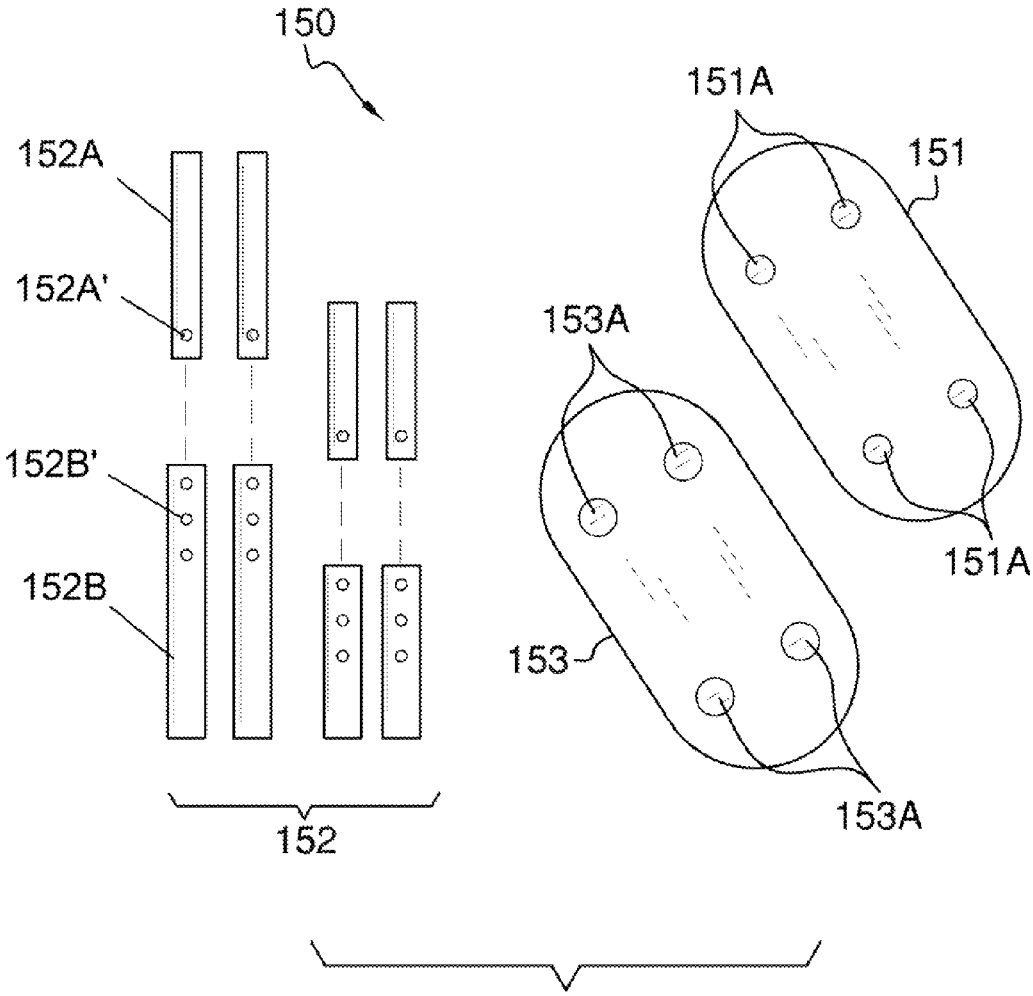
FIG. 7 illustrates the components used to construct the alternative embodiment.

Referring to FIGS. 6 and 7, an alternative embodiment of the invention 150 employs the use of a footrest 151, a plurality of rods 152, and a base 153. The rods 152 are each composed of a top member 152A that is slideably engaged with respect to a bottom member 152B. The bottom members 152B have different lengths as well as a plurality of holes 152B', which enables adjustment of the overall height of the rod 152 via spring-loaded buttons 152A' located on the top members 152A. The rods 152 are also used to form an angle 150' that is useful when placing a shoe thereon in order to tie or untie said shoe by an end user.

The footrest 151 includes a pattern of holes 151A on a bottom surface; whereas the base 153 includes a pattern of holes 153A on a top surface. The pattern of holes 151A and 153A are mirror images of one another, and enable the rods 152 to slide therein in order to form the invention 150. It shall be noted that the invention 150 enables complete assembly and disassembly by simply removing the parts, which may be desirable for storage purposes.

The footrest 151 includes a heel stop that is similar to the heel stop 101B of the invention 100 depicted and described in FIGS. 1-5.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An articulating foot-elevating support comprising:

a footrest extending above an elevating means that is mounted within a base;

wherein the footrest includes a foot imprint upon a top surface that indicates visually the placement and orientation of a foot thereon;

wherein the foot-elevating support is used to assist an end user in tying or untying shoelaces of a shoe;

wherein the footrest can articulate via a pivot point along an axis aligned with the ankle of the end user;

wherein the footrest and the base have curved ends, and the footrest can rest atop the base to form a box;

wherein the elevating means includes a plurality of telescoping sections, and includes a topmost telescoping section;

wherein the telescoping sections have decreasing diameters;

wherein the topmost telescoping section attaches to a bracket that is secured to a bottom surface of the footrest;

wherein each telescoping section is a hydraulically operated cylinder; wherein the hydraulically operated cylinders are in fluid communication with a reservoir located within the base; wherein the reservoir includes a positive pressure, which raises the telescoping sections when tapped upon by a foot; whereupon disservice requires the end user to push his or her foot down to retract the elevating means within the base.

2. The articulating foot-elevating support as described in claim 1 wherein the footrest includes a heel stop at a heel portion of the foot imprint of the footrest such that a shoe or foot does not slide off of the footrest when in use.

3. An articulating foot-elevating support comprising:

a footrest extending above an elevating means that is mounted within a base;

wherein the footrest includes a foot imprint upon a top surface that indicates visually the placement and orientation of a foot thereon;

wherein the foot-elevating support is used to assist an end user in tying or untying shoelaces of a shoe;

wherein the footrest can articulate via a pivot point along an axis aligned with the ankle of the end user;

wherein the elevating means includes a plurality of telescoping sections, and includes a topmost telescoping section;

wherein the topmost telescoping section attaches to a bracket that is secured to a bottom surface of the footrest;

wherein the footrest and the base have curved ends, and the footrest can rest atop the base to form a box;

wherein the telescoping sections have decreasing diameters;

wherein each telescoping section is a hydraulically operated cylinder; wherein the hydraulically operated cylinders are in fluid communication with a reservoir located within the base; wherein the reservoir includes a positive pressure, which raises the telescoping sections when tapped upon by a foot; whereupon disservice requires the end user to push his or her foot down to retract the elevating means within the base.

4. The articulating foot-elevating support as described in claim 3 wherein the footrest includes a heel stop at a heel portion of the foot imprint of the footrest such that a shoe or foot does not slide off of the footrest when in use.

5. A foot-elevating support comprising:

a footrest, a plurality of rods, and a base constructed together to form an angled footrest upon which an end user may rest a shoe thereon for tying or untying shoelaces thereon;

wherein the footrest includes a foot imprint upon a top surface that indicates visually the placement and orientation of a foot thereon;

wherein the rods have different lengths, and are used to connect the footrest to the base;

wherein the different lengths of the rods form an angle that is useful when placing a shoe thereon in order to tie or untie said shoe by an end user;

wherein the footrest includes a pattern of holes on a bottom surface; whereas the base includes a pattern of holes on a top surface; wherein the pattern of holes of the footrest and the pattern of holes of the base are mirror images of one another, and enable the rods to slide therein in order to form the foot-elevating support;

wherein the footrest includes a heel stop at a heel portion of the foot imprint of the footrest such that a shoe or foot does not slide off of the footrest when in use;

wherein the rods are each composed of a top member that is slideably engaged with respect to a bottom member.

6. The articulating foot-elevating support as described in claim 5 wherein the bottom members have different lengths.

7. The articulating foot-elevating support as described in claim 5 wherein the bottom members each include a plurality of holes, which enables adjustment of the overall height of the rod via spring-loaded buttons located on the top members.

* * * * *